US005219084A

United States Patent [19]

King

[11] Patent Number: 5,219,084

[45] Date of Patent: Jun. 15, 1993

[54] CONTAINER NECK AND A CLOSURE THEREFOR

[75] Inventor: Roger M. King, Bucks, England

[73] Assignee: Beeson and Sons Limited, United Kingdom

[21] Appl. No.: 835,290

[22] Filed: Feb. 13, 1992

[30] Foreign Application Priority Data

Dec. 11, 1991 [GB] United Kingdom ..... 9126242

[51] Int. Cl.[5] ..... B65D 41/34

[52] U.S. Cl. ..... 215/252; 215/220; 215/305

[58] Field of Search ..... 215/252, 258, 219, 220, 215/221, 295, 305

[56] References Cited

U.S. PATENT DOCUMENTS

| | | | |
|---|---|---|---|
| 3,737,064 | 6/1973 | Patel et al. | 215/252 |
| 3,944,102 | 3/1976 | Grau | 215/251 |
| 4,147,268 | 4/1979 | Patel et al. | 215/252 |
| 4,157,144 | 6/1979 | Weiler et al. | 215/252 |
| 4,289,248 | 9/1981 | Lynn . | |
| 4,387,822 | 6/1983 | Lynn . | |
| 4,469,235 | 9/1984 | Parker | 215/295 |
| 4,493,427 | 1/1985 | Wolkonsky | 215/230 |
| 4,562,931 | 1/1986 | Brach et al. | 215/220 |
| 4,731,512 | 3/1988 | Barriac | 215/220 |
| 4,746,026 | 5/1988 | Leonhardt | 215/252 |
| 4,770,308 | 9/1988 | Lynn . | |

FOREIGN PATENT DOCUMENTS

| | | | |
|---|---|---|---|
| 117948 | 9/1984 | European Pat. Off. . | |
| 3605963 | 8/1987 | Fed. Rep. of Germany | 215/220 |
| 2036272 | 12/1970 | France . | |
| 2558443 | 7/1985 | France . | |
| 2572369 | 5/1986 | France . | |
| 2134873 | 8/1984 | United Kingdom . | |

*Primary Examiner*—Stephen P. Garbe
*Assistant Examiner*—Nova Stucker
*Attorney, Agent, or Firm*—Willian Brinks Olds Hofer Gilson & Lione

[57] ABSTRACT

A container closure assembly is disclosed including a tamper evident ring. The ring is initially substantially concealed by the closure when the closure is first fitted to the neck of the container. After the occasion on which the closure is first removed from the container neck, the tamper evident ring remains substantially visible on the container neck when the closure is replaced on the neck. The closure may include a recess for receiving the ring to conceal the ring, and releasable holding means for retaining the ring in the recess until the closure is removed for the first time. The ring may be slidably retained on a portion of the container neck.

6 Claims, 3 Drawing Sheets

CONTAINER NECK AND A CLOSURE THEREFOR

FIELD OF THE INVENTION

This invention relates to a container neck and to a closure for a container neck. In particular, the invention relates to the arrangement of a tamper-evident ring for the container neck and closure.

BACKGROUND OF THE INVENTION

Commonly, tamper-evident rings are provided on closures for containers to indicate whether the container has been opened since manufacture, and to act as a guarantee that the contents of the container have not been tampered with. Such rings are often provided on containers for food, drink and medicaments, as well as containers for other items.

A conventional design for a tamper-evident ring is to mount the ring externally of the closure and the container neck, and to secure it to the closure by thin frangible connections. When the closure is removed from the container, the connections become broken to the release the tamper-evident ring. If a purchaser sees that the ring is not intact with the closure, this indicates that the closure has already been removed at least once from the container.

However, such a design of tamper-evident ring is rather unsightly because it gives the closure a bulky appearance. It can also sometimes be difficult to discern without close inspection whether the ring is intact with the closure, or whether the frangible connections have in fact been broken.

SUMMARY OF THE INVENTION

The present invention aims to overcome the above and/or other drawbacks.

In a first aspect, the invention provides an assembly comprising a container neck, a closure adapted to fit the neck, and a tamper-evident ring, the ring being initially substantially concealed by the closure when the closure is fitted to the container neck, the arrangement being such that, in use, after the occasion on which the closure is first removed from the container neck, the tamper-evident ring remains substantially visible on the container neck when the closure is replaced on the neck.

Such an arrangement provides a positive indication once the closure has been removed for the first time. The positive indication is the appearing of the tamper-evident ring itself. The invention appreciates the real essence of a tamper-evident ring, which is, to provide a warning or positive indication if the closure has been removed from the container at least once. It is not necessary to see the tamper-evident ring if the ring is properly intact.

Before the closure has been opened for the first time the tamper-evident ring, being substantially concealed by the closure, also will not give the closure an unsightly appearance.

Preferably, the tamper-evident ring is movably retained on the container neck, and the assembly further comprises releasable holding means for initially holding the tamper-evident ring in a first position in which it is substantially concealed by the closure, the holding means releasing the tamper-evident ring when the closure is first removed from the container, to allow the ring to move into a second position in which it is not substantially concealed by the closure when the closure is replaced on the container neck.

Preferably, the holding means comprises severable connections between the tamper-evident ring and the closure, which connections are severed when the closure is first removed from the container neck.

The tamper-evident ring may be coloured a contrasting colour to the container so that the tamper-evident ring will be clearly visible, and easily discernable at a glance, once the closure has been removed for the first time. For example, the tamper-evident ring may be coloured red as a warning colour.

The portion of the container neck on which the tamper-evident ring sits when in its visible, second position may itself be coloured a colour which contrasts both the rest of the container and the tamper-evident ring. When the tamper-evident ring is in its concealed, first position, this portion of the neck will be visible, and so it may be coloured with a safety colour, such as blue or green, to indicate that the tamper-evident ring arrangement is intact.

Preferably, the tamper-evident ring is slidably retained on a portion of the neck, and is retained thereon. This prevents a person who has maliciously tampered with the container from the tamper-evident ring arrangement is intact.

Preferably, in the second position the tamper-evident ring is separated from the bottom of the closure by a distance at least equalling the axial width of the tamper-evident ring. With such an arrangement, a user can see quite clearly at a glance that the tamper-evident ring is detached from the closure.

Preferably, the closure includes a recess, or a clearance, in which the tamper-evident ring is received when in its concealed, first position. The severable connections are preferably made between an inner wall or walls of the recess, and an edge of the tamper-evident ring. The recess may be defined by a skirt portion of the closure, which covers the tamper-evident ring.

The closure may be of any suitable type, for example, a screw-on closure, or a snap-fit closure. The invention is also particularly suitable for use with a child resistant closure, such as that described in our U.S. patent application Ser. No. 07/796946 entitled "Improvements in Closures For Containers" (claiming priority from our U.K. applications Nos. 9120264.8 and 9122097.0) and the disclosure of which is incorporated herein by reference. The feature which makes the invention suitable for use with such a closure is that the tamper-evident ring does not interfere with the axial or rotational movement of the outer part of the child-resistant closure.

In a closely related aspect, the invention also provides a closure adapted to fit a container neck, the closure comprising a tamper-evident ring and means for substantially concealing the tamper-evident ring from view when in use on a container, until the closure is first removed from the container neck.

Preferably, the concealing means comprises a recess or clearance within the closure in which recess or clearance the tamper-evident ring is substantially received, and holding means for initially holding the tamper-evident ring within the recess or clearance until the closure is removed from the container neck on the first occasion, whereupon the holding means releases the tamper-evident ring so that it will no longer be concealed within the clearance or recess when the closure is replaced.

The concealing means may be in the form of a skirt portion of the closure which covers the tamper-evident ring.

Preferably, the holding means comprises means for forming severable connections with the tamper-evident ring, which connections are intended to be severed on the first occasion that the closure is removed from the container neck.

DESCRIPTION OF THE DRAWINGS

An embodiment of the invention will now be described by way of example with reference to the accompanying drawings in which.

DESCRIPTION OF THE PREFERRED EMBODIMENTS

Figure 1:
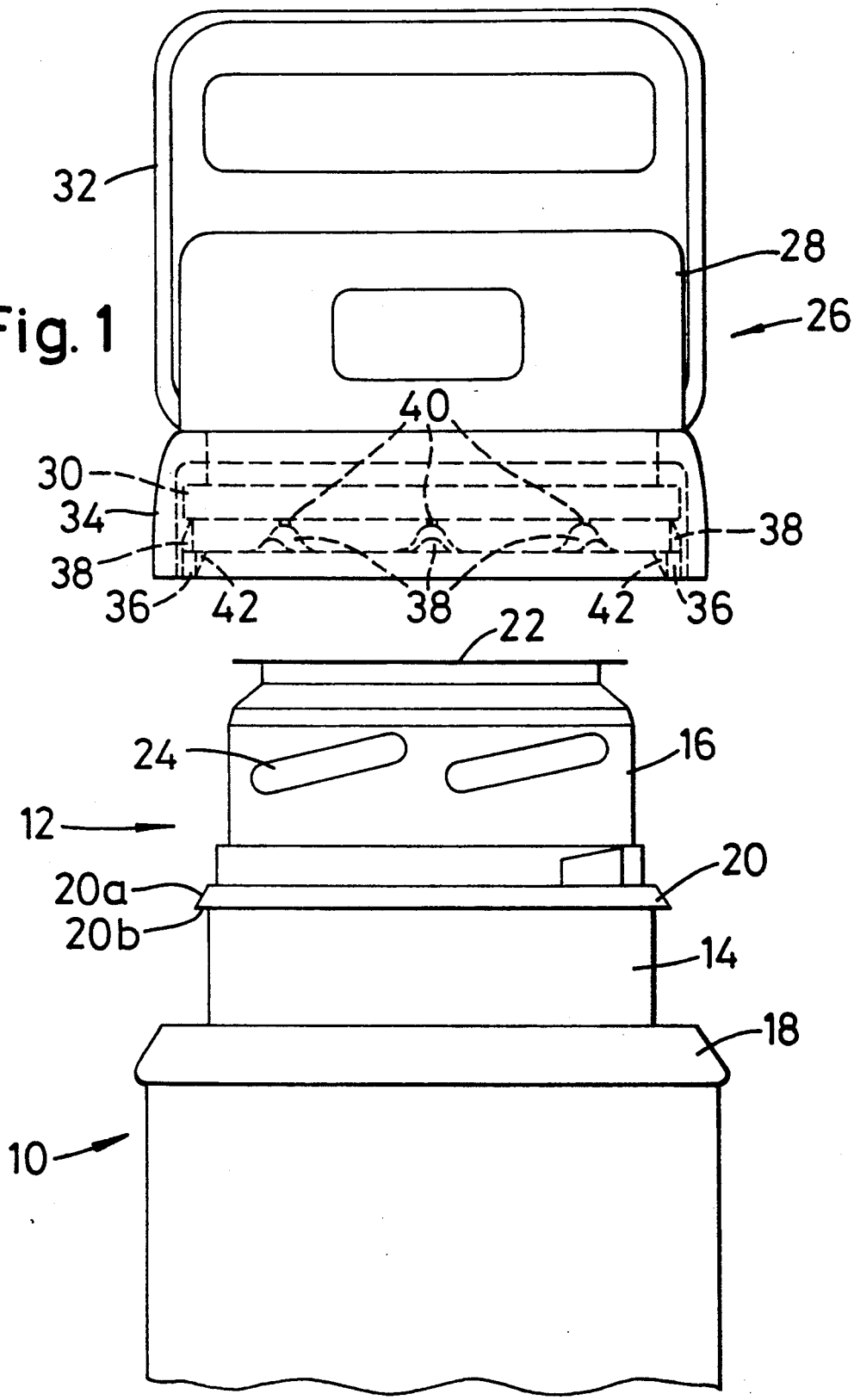
FIG. 1 is a side view of a container with it closure removed.
Figure 2:
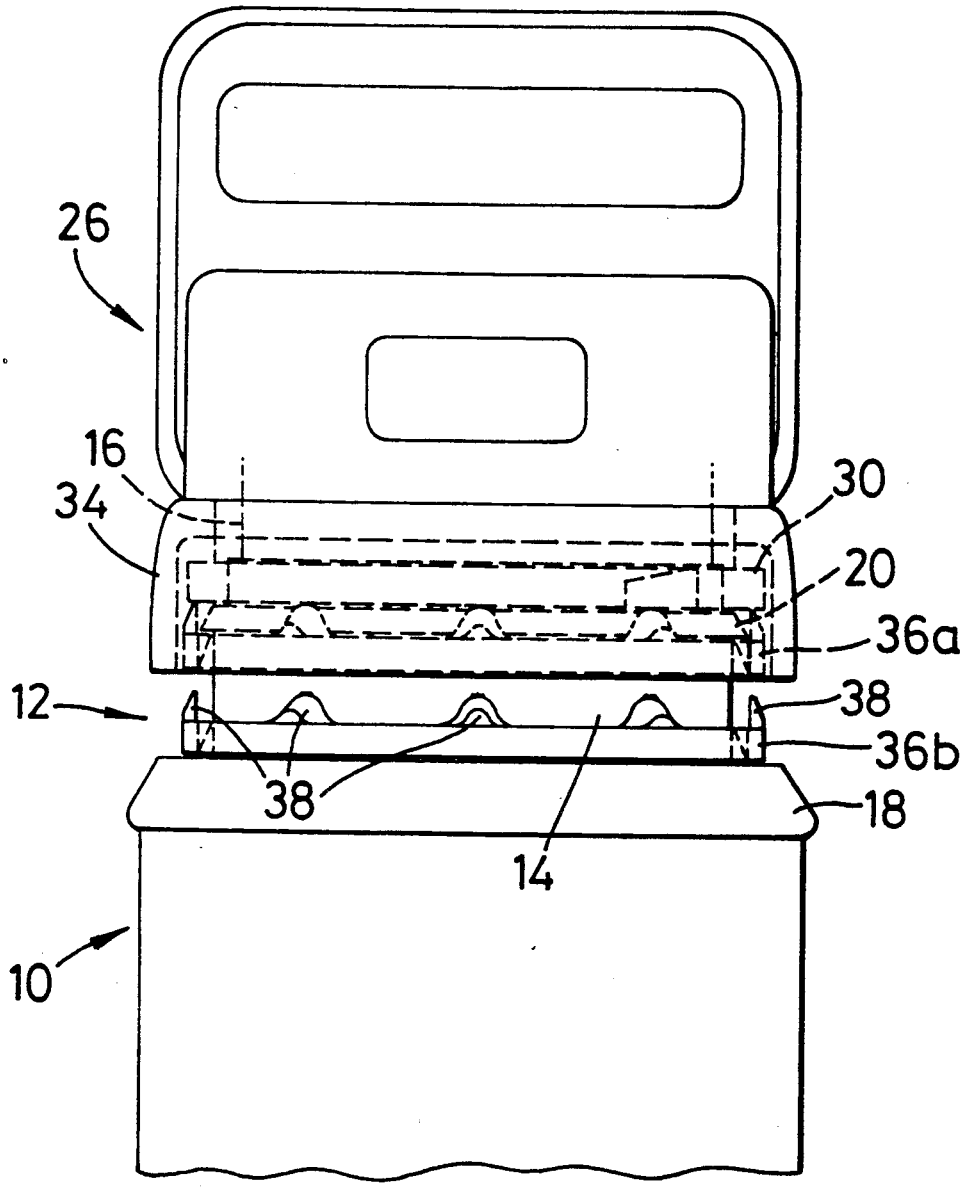
FIG. 2 is a side view of the container of FIG. 1 with its closure fitted.
Figure 3:
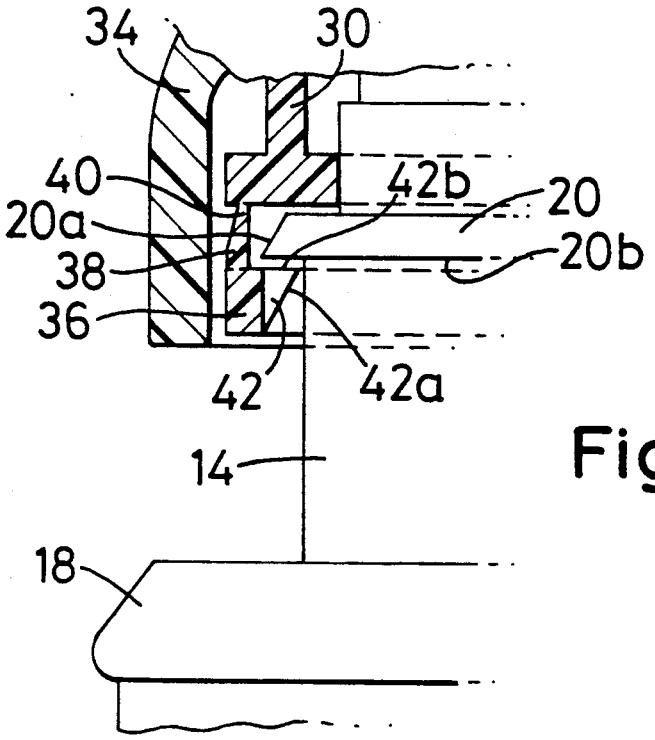
FIG. 3 is a sectional view from the side showing a detail of the container neck and closure in FIG. 2.

The drawings FIGS. 1 to 3 show a container 10 with a neck portion 12 which has a lower waist portion 14 and an upper crown portion 16. The waist portion 14 is defined at its lower end by a shoulder 18 which joins the neck 12 to the body of the container, and at its upper end by an abutment flange 20. The flange 20 has an radially inwardly inclined upper surface 20*a* and a flat lower abutment surface 20*b*. The waist portion 14 is adapted to receive a tamper-evident ring as described hereinafter, and the shoulder 18 and the flange 20 together form retaining means for retaining the ring on the waist portion 14 once the ring has been fitted.

The crown portion 16 of the neck 12 has a foil sealing web 22, and carries screw threads 24 adapted to secure a closure means in the form of a screw threaded closure 26 to the container 10.

In this exemplary embodiment, the closure 26 is a child-resistant closure of the type described in our U.S. patent application Ser. No. 07/796946, although it will be appreciated that other types of child-resistant or non-child-resistant closures might be used instead.

The closure 26 comprises an outer closure part 28 and an inner closure part 30. The outer part 28 has an upstanding flange handle 32, and a lower skirt-portion 34. The inner part 30 is coupled internally to the outer part 28 through a child-resistant mechanism (not shown), and carries an inner screw thread (not shown) to match the screw threads 24 of the container neck 12.

The closure 26 is fitted with a tamper-evident ring 36 in the form of an annular member which is received substantially entirely within the recess, or clearance, inside the skirt portion 34 of the closure. Attached to the top of the ring 36 and integral therewith are eight connecting members 38 which taper upwards from a relatively thick lower region into a relatively thin frangible bridge 40 attached to the bottom of the inner part 30 of the closure 26. On the radially inner face of the ring 36, extending between the connecting members 38, are eight triangular section ring retaining clips 42 which are adapted to engage the abutment flange 20 of the container neck 12. Each clip 42 is profiled with a radially inwardly tapered lower ramp surface 42*a* and a flat upper abutment surface 42*b*.

Once the desired contents have been placed in the container 10, the closure 26 is screwed on in the normal way, to secure the container in a sealed condition ready for sale. As the closure 26 is screwed down for the first time, the ramp surfaces 42*a* of the ring retaining clips 42 bear against the tapered surfaces 20*a* of the flange 20. The ring 36 deforms sufficiently to allow the ramp surfaces 42*a* to ride easily over the flange 20. When the closure reaches its fully screwed-down position, the ring 36 will be in the a first position in the neck 12 as illustrated at 36*a* in FIG. 2, fitting immediately under the flange 20.

In this position, the tamper-evident ring 36 is substantially concealed from view by the outer part 28 of the closure 26. In this condition, the assembly indicates that the closure 26 has not been removed since it was first fitted on to the container.

When the closure 26 is unscrewed for the first time, the abutment surfaces 42*b* of the ring retaining clips 42 bear against the abutment surface 20*b* of the flange 20 to prevent the ring 36 from being removable from the neck 12 with the closure. The frangible bridges 40 act as severable connections which are severed as the closure 26 is unscrewed, so that the ring 36 becomes detached from the closure 26. Once detached, the ring 36 is free to slide axially down the waist portion 14 of the neck 12, until it rests at a second position against the shoulder 18 as denoted at 36*b* in FIG. 2.

When the closure is replaced on the neck 12, the lower skirt portion 34 of the closure no longer conceals the tamper-evident ring 36, and the ring remains visible on the neck 12 to indicate that the closure has been removed at least once since it was first fitted.

In its visible position, the tamper-evident ring 36 is separated from the bottom of the skirt portion 34 of the closure 26 by at least a distance equalling the axial width of the tamper-evident ring. This enables a user, or potential purchaser, to see clearly at a glance that the tamper-evident ring 36 is detached from the closure 26.

The ring 36 is slidable on the waist portion 14 of the neck 12, but is held captive thereon by the shoulder 18 and the abutment flange 20. This ensures that the ring 26 cannot be discarded once it has become detached from the closure 26, and the ring remains on the neck 12 as a permanent indication that the closure 26 has been removed at least once.

The skirt portion 34 of the closure 26 thus acts as a means for concealing the tamper evident ring 36 from view until the closure is removed from the container neck for the first time. The arrangement of the skirt portion 34 of the closure, the severable, or frangible, connections 38, and the abutment flange 20 of the neck together provide means for substantially concealing the tamper evident ring when the closure is fitted to the container neck, until the occasion on which the closure is removed for the first time, and for unconcealing the tamper evident ring, or enabling the ring to be displayed, when the closure is removed for the first time so that the tamper evident ring will remain substantially visible on the container neck when the closure is replaced on the neck. The skirt portion defining the recess in the closure acts as means capable of concealing the tamper evident ring and the frangible bridges act as means for retaining the ring concealed by the skirt portion until the closure is removed for the first time.

The tamper-evident ring 36 is coloured a contrasting colour to the rest of the container and closure, so that it will be clearly visible on the container neck once it has become detached from the closure.

It will be appreciated that this embodiment of the invention is suitable for use with a child-resistant closure, because it does not interfere with the axial movement of the outer closure part 28, and the tamper-evident ring 36 will not become detached if a child tries to open the container 10 by rotating the outer closure part 28. However, the principles of the invention are equally applicable for other types of non-child-resistant screw-on or snap-fit closures.

Figure 4:
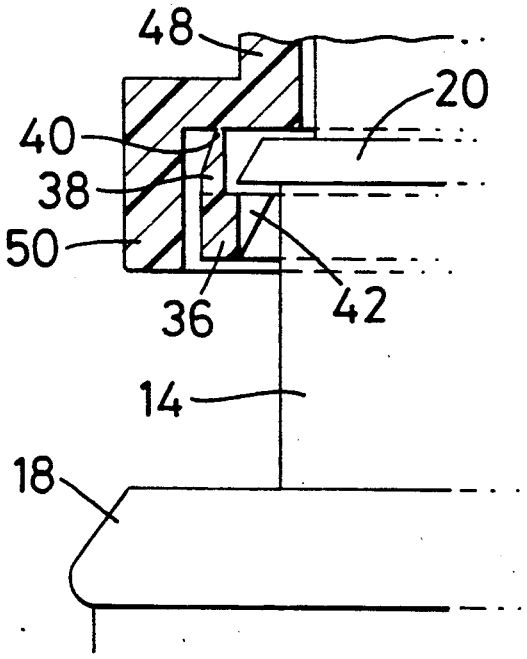
FIG. 4 is a sectional view similar to FIG. 3, but showing the tamper-evident ring fitted to a non-child-resistant closure.

FIG. 4 shows a modified embodiment including a non-child-resistant closure. In this embodiment, the inner and outer closure parts described previously are replaced by a single-part closure member 48, which may be a screw-threaded closure or a snap-fit closure. The tamper-evident ring 36 is substantially concealed within a lower skirt portion 50 of the closure, and is severably connected thereto by the thin frangible webs 40 in the same manner as described previously.

Although in the preferred embodiment described above the tamper-evident ring is coupled to the closure by severable connections which, in use, are severed by axial forces, in other embodiments, other types of tamper-evident ring may be used. For example, rings which are severed by circumferential twisting forces, or by cutting devices on the neck or closure, may be used.

It will of course be understood that the present invention has been described above purely by way of example, and modifications of detail can be made within the scope of the invention.

I claim:

1. A container closure assembly comprising:

a container neck;

a removable closure adapted to fit said container neck, said closure including a skirt portion defining a recess or clearance;

a tamper evident ring for indicating whether the removable closure has been opened since manufacture, wherein the tamper evident ring is adapted to be retained on said container neck, said tamper evident ring being integrally formed with said closure and joined thereto by severable integral connections so that said tamper evident ring is retained concealed within said recess or clearance until said closure is removed from said container neck for the first time whereupon said tamper evident ring becomes severed completely from said closure, the arrangement being such that said tamper evident ring remains substantially visible on said container neck when said closure is replaced on said container neck.

2. A container closure assembly according to claim 1, wherein said tamper evident ring is slidable on said container neck, the arrangement being such that when said tamper evident ring becomes severed from said closure, said tamper evident ring slides into a released position on said container neck in which said tamper evident ring is not substantially concealed when said closure is replaced on said container neck.

3. A container closure assembly according to claim 2, wherein said tamper evident ring when in said released position is separated from said closure by a distance at least equalling the axial width of said tamper evident ring.

4. A container closure assembly according to claim 1, wherein said tamper evident ring is coloured a contrasting colour to the colour of said container neck so that said tamper evident ring is easily discernable at a glance once said closure has been removed from the first time.

5. A container closure assembly comprising:

a container neck;

a removable closure adapted to fit said container neck;

a child-resistant device for preventing removal of the closure by a young child;

a tamper evident ring;

a first concealment device for substantially concealing said tamper evident ring when said closure is fitted to said container neck, until the occasion on which said closure is removed from said container neck for the first time, the arrangement being such that said tamper evident ring remains substantially visible on said container neck when said closure is replaced on said container neck;

wherein said first concealment device comprises a second concealment device on said closure capable of concealing said tamper evident ring, and a first retainer for retaining said tamper evident ring concealed by said second concealment device, until said closure is removed for the first time;

a second retainer for removably retaining said tamper evident ring on said closure neck, and wherein said second retainer ring comprises a releasable holder for initially holding said tamper evident ring in a first position in which it is substantially concealed by said second concealment device on said closure, said holder releasing said tamper evident ring when said closure is first removed from said container neck, to allow said tamper evident ring to move into a second position in which it is not substantially concealed by said second concealment device on said closure when said closure is replaced on said container neck;

wherein said releasable holder comprises severable connections between said tamper evident ring and said closure, said severable connections being severed when said closure is removed from said container neck for the first time; and wherein said child-resistant device and said closure together comprise an inner closure part attachable to said container neck, an outer closure part substantially covering said inner closure part, and a child-resistant mechanism coupling said inner and outer closure parts, aid severable connections comprising connections joining said tamper evident ring to said inner closure part, and said second concealment device comprising a portion of said outer closure part.

6. A closure assembly for a container neck, said closure assembly comprising:

a closure adapted to fit said container neck and be removable therefrom;

a child-resistant device for preventing removal of the closure by a young child;

a tamper evident ring;

a concealment device for substantially concealing said tamper evident ring from view when in use on said container neck, until said closure is first removed from said container neck;

wherein said concealment device comprises a recess or clearance within said closure, said recess or clearance receiving said tamper evident ring when said tamper evident ring is substantially concealed from view;

wherein said concealment device further comprises a releasable holder for initially holding said tamper evident ring in said recess or clearance until said closure is removed from said container neck on the first occasion whereupon said holder releases said tamper evident ring so that it will no longer be concealed within said clearance or recess when said closure is replaced on said container neck; and wherein said closure and said child-resistant device together comprise an inner closure part attachable to said container neck, an outer closure part substantially covering said inner closure part, and a child-resistant mechanism coupling said inner and outer closure parts, said releasable holding means comprising severable connections joining said tamper evident ring to said inner closure part, and said recess or clearance being defined by a portion of said outer closure part.

* * * * *

UNITED STATES PATENT AND TRADEMARK OFFICE

CERTIFICATE OF CORRECTION

PATENT NO. : 5,219,084
DATED : June 15, 1993
INVENTOR(S) : Roger M. King

It is certified that error appears in the above-indentified patent and that said Letters Patent is hereby corrected as shown below:

In column 1, line 23, delete the third occurrence of "the".

In column 2, lines 25-26, delete "the tamper-evident ring arrangement is intact." and substitute --discarding the tamper-evident ring.--.

In column 3, line 14, delete "it" and substitute --its--.

In column 3, line 31, delete the second occurrence of "an" and substitute --a--.

In column 4, line 10, delete "a".

In column 4, lines 49, 55, 58, 60 and 64 delete each occurrence of "tamper evident" and substitute --tamper-evident--.

Column 5, claim 1, lines 6, 8, 9-10, 12, 15 and 17 delete each occurrence of "tamper evident" and substitute --tamper-evident--.

UNITED STATES PATENT AND TRADEMARK OFFICE

CERTIFICATE OF CORRECTION

PATENT NO. : 5,219,084
DATED : June 15, 1993
INVENTOR(S) : Robert M. King

It is certified that error appears in the above-indentified patent and that said Letters Patent is hereby corrected as shown below:

Column 5, claim 2, lines 2, 4, 5 and 6-7, delete each occurrence of "tamper evident" and substitute --tamper-evident--.

Column 5, claim 3, lines 2 and 4, delete each occurrence of "tamper evident" and substitute --tamper-evident--.

Column 5, claim 4, lines 2 and 4 delete each occurrence of "tamper evident" and substitute --tamper-evident--.

Column 6, claim 5, lines 7, 9, 13, 18, 19, 22-23, 25, 28, 30, 36 and 46 delete each occurrence of "tamper evident" and substitute --tamper-evident--.

Column 6, claim 5, line 24, delete "ring".

Column 6, claim 6, lines 7, 9, 14, 15, 18-19, 22 and 32 delete each occurrence of "tamper evident" and substitute --tamper-evident--.

Signed and Sealed this

Third Day of October, 1995

Bruce Lehman

*Attest:*

BRUCE LEHMAN

*Attesting Officer*

*Commissioner of Patents and Trademarks*